US010705485B2

(12) United States Patent
Okamura

(10) Patent No.: US 10,705,485 B2
(45) Date of Patent: Jul. 7, 2020

(54) POINTER AND TIMEPIECE

(71) Applicant: CASIO COMPUTER CO., LTD., Tokyo (JP)

(72) Inventor: Naoki Okamura, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 158 days.

(21) Appl. No.: 15/884,770

(22) Filed: Jan. 31, 2018

(65) Prior Publication Data

US 2018/0259907 A1 Sep. 13, 2018

(30) Foreign Application Priority Data

Mar. 8, 2017 (JP) ..... 2017-043763

(51) Int. Cl.
*G04B 19/04* (2006.01)
*G04B 19/247* (2006.01)

(52) U.S. Cl.
CPC ..... *G04B 19/044* (2013.01); *G04B 19/042* (2013.01); *G04B 19/247* (2013.01)

(58) Field of Classification Search
CPC ..... G01D 13/22–28; G04B 19/04–044; G04B 31/00; G04B 31/004; G04B 31/012–06
See application file for complete search history.

(56) References Cited

U.S. PATENT DOCUMENTS 4,132,188 A * 1/1979 Gjertsen ..... F16D 1/072 116/332
5,553,480 A * 9/1996 Rose ..... G01D 13/22 116/291
6,180,041 B1 * 1/2001 Takizawa ..... G01D 13/22 264/255
9,804,569 B2 * 10/2017 Enta ..... G04B 19/044

FOREIGN PATENT DOCUMENTS

CN 204989766 U 1/2016
JP 2015-114295 A 6/2015
JP 2016-099182 A 5/2016

OTHER PUBLICATIONS

Awano, Yusuke, English Translation of JP2015114295, originally published Jun. 22, 2015, retrieved from Espacenet on Aug. 30, 2019, full document (Year: 2015).*
Notification of Reasons for Refusal dated Jan. 10, 2019 received in Japanese Patent Application No. JP 2017-043763 together with an English language translation.
First Office Action dated Sep. 4, 2019 received in Chinese Patent Application No. CN 201810149646.4 together with an English language translation.

* cited by examiner

*Primary Examiner* — Daniel P Wicklund
(74) *Attorney, Agent, or Firm* — Scully Scott Murphy & Presser

(57) ABSTRACT

A pointer including a pointer body formed of synthetic resin, and a pointer attachment section formed of a material harder than the synthetic resin and provided in a rotation center (Continued)

portion of the pointer body, in which the pointer attachment section comprises a large-diameter section to which the pointer body is fixed and which includes a positioning section, and a small-diameter section which is provided coaxially with the large-diameter section and to which a pointer shaft is attached.

6 Claims, 5 Drawing Sheets

POINTER AND TIMEPIECE

CROSS-REFERENCE TO RELATED APPLICATION

This application is based upon and claims the benefit of priority from the prior Japanese Patent Application No. 2017-043763, filed Mar. 8, 2017, the entire contents of which are incorporated herein by reference.

BACKGROUND OF THE INVENTION

1. Field of the Invention

The present invention relates to a pointer which is used for timepieces such as wristwatches and a timepiece including the same.

2. Description of the Related Art

For example, a pointer for a wristwatch is known which has a structure where a pointer body made of synthetic resin and a metal pointer attachment section that is provided in a rotation center portion of the pointer body have been integrally formed by insert molding, as described in Japanese Patent Application Laid-Open (Kokai) Publication No. 2015-114295.

The pointer attachment section of this pointer for a wristwatch is formed to have a cylindrical shape where a pointer shaft is inserted and attached, and to have an inner diameter larger than the thickness of the pointer body so as to be fixed in a mold for molding by a positioning pin of the mold being inserted thereinto at the time of insert molding.

That is, when the cylindrical pointer attachment section of this pointer is placed in the mold for molding so as to perform insert molding, this cylindrical pointer attachment section is required to be fixed in the mold by the positioning pin being inserted thereinto so that it does not move within the mold when an injection pressure is applied by synthetic resin being injected into the mold.

Accordingly, in the case of this pointer, the inner diameter of the pointer attachment section cannot be made smaller. In addition, by being required to have the same size as the inner diameter of the pointer attachment section, the outer diameter of the pointer shaft to be inserted into the pointer attachment section is large, and therefore the pointer shaft cannot be formed to be thin.

SUMMARY OF THE INVENTION

An object of the present invention is to provide a pointer for which the outer diameter of a pointer shaft can be made small and a pointer body can be favorably molded, and a timepiece including the same.

In accordance with one aspect of the present invention, there is provided a pointer comprising: a pointer body formed of synthetic resin; and a pointer attachment section formed of a material harder than the synthetic resin and provided in a rotation center portion of the pointer body, wherein the pointer attachment section comprises a large-diameter section to which the pointer body is fixed and which includes a positioning section, and a small-diameter section which is provided coaxially with the large-diameter section and to which a pointer shaft is attached.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment where the present invention has been applied in a wristwatch will hereinafter be described with reference to FIG. 1 to FIG. 5.

Figure 1:
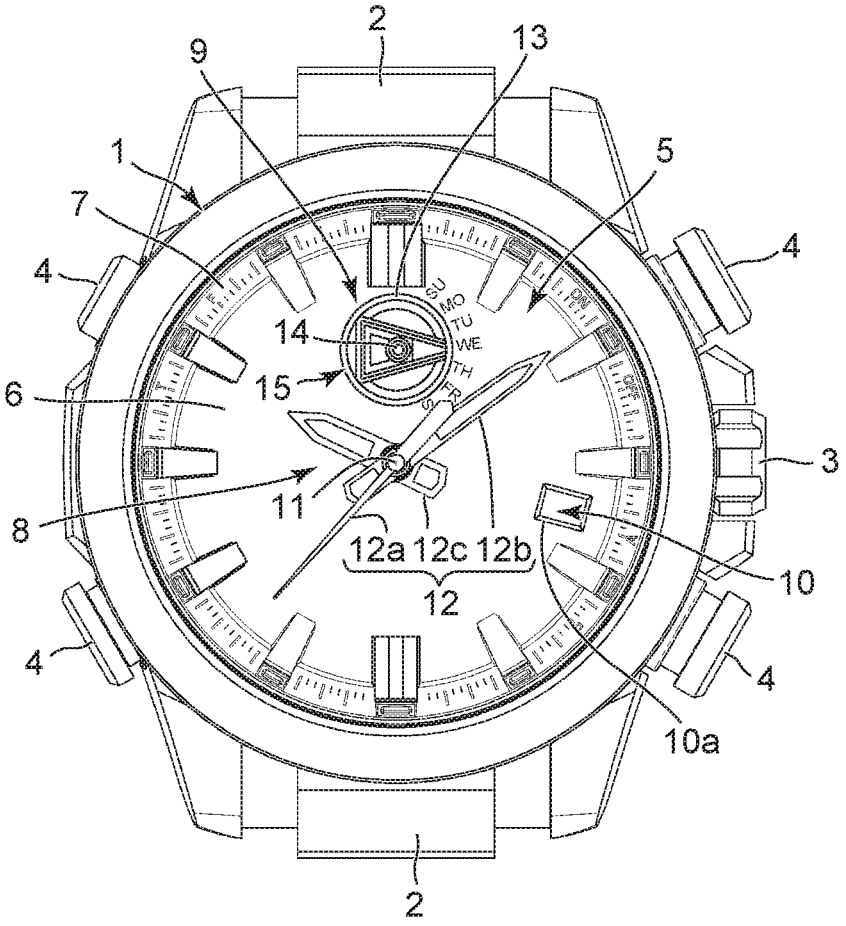
FIG. 1 is an enlarged front view showing an embodiment where the present invention has been applied in a wristwatch.

This wristwatch includes a wristwatch case 1, as shown in FIG. 1. On side portions of this wristwatch case 1 on the six o'clock side and the twelve o'clock side, band attachment sections 2 are respectively provided. Also, on a side portion of this wristwatch case 1 on the 3 o'clock side, a switch operation section 3 such as a crown is provided. Further, on side portions of this wristwatch case 1 on the 2 o'clock side, the 4 o'clock side, the 8 o'clock side, and the 10 o'clock side, push-button switches 4 are respectively provided.

In this wristwatch case 1, a timepiece module 5 is provided, as shown in FIG. 1. This timepiece module 5 is structured such that a dial 6 is arranged on its upper surface and a parting member 7 is arranged on an outer peripheral portion on the upper surface of this dial 6. In this embodiment, the timepiece module 5 includes a main display section 8 which indicates and displays a current time, a sub-display section 9 which indicates and displays a day of the week, and a display section 10 which displays information such as a date.

The main display section 8 is structured such that the upper end of a pointer shaft 11 provided in a center portion of the dial 8 protrudes upward from the dial 6, and pointers 12 such as a second hand 12*a*, a minute hand 12*b*, and an hour hand 12*c* are attached to the upper end of this protruding pointer shaft 11, as shown in FIG. 1. As a result, the main display section 8 is structured such that the pointer shaft 11 is rotated by a train wheel mechanism (not shown) so as to move the pointers 12 above the dial 6 and thereby indicate and display the time.

The sub-display section 9 is structured such that a sub-pointer shaft 14 is provided in a center portion of a sub-display area 13 which is a circular hole provided between the center of the dial 6 and an outer peripheral portion of the dial 6 on the 12 o'clock side, and a sub-pointer 15 is attached to the upper end 14*a* (see FIG. 3A and FIG. 3B) of this sub-pointer shaft 14, as shown in FIG. 1. As a result, the sub-display section 9 is structured such that the sub-pointer shaft 14 is rotated by the train wheel mechanism (not shown) so as to move the sub-pointer 15 within the sub-display area 13 and thereby indicate and display a day of the week.

The display device 10 includes a flat display panel such as a liquid crystal display panel or an electroluminescence (EL) display panel and electrooptically displays information such as a date, as shown in FIG. 1. This display section 10, which is arranged corresponding to an area below the display window section 10*a* provided between the center of the dial 6 and an outer peripheral portion of the dial 6 on the three o'clock side, is structured such that displayed information such as a date can be viewed from above via the display window section 10*a*. Note that the display section 10 may be a date wheel structured to rotate and move below the dial 6 so that information such as a date can be viewed from above via the display window section 10*a*.

Figure 2:
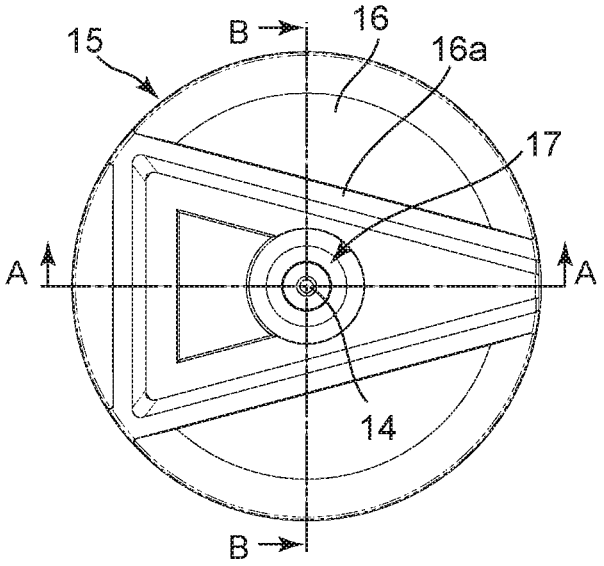
FIG. 2 is an enlarged front view showing a sub-pointer in a sub-display section in the wristwatch shown in FIG. 1.
Figure 3A:
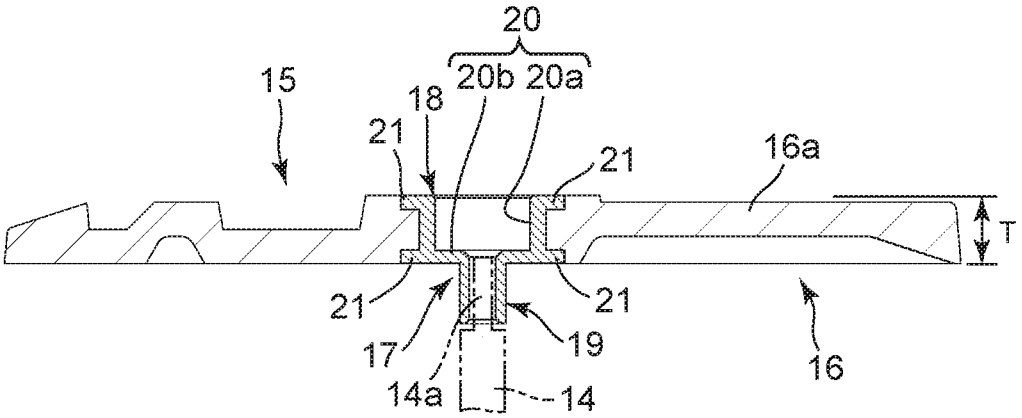
FIG. 3A is an enlarged sectional view showing a cross section of the sub-pointer taken along line A-A in FIG. 2.
Figure 3B:
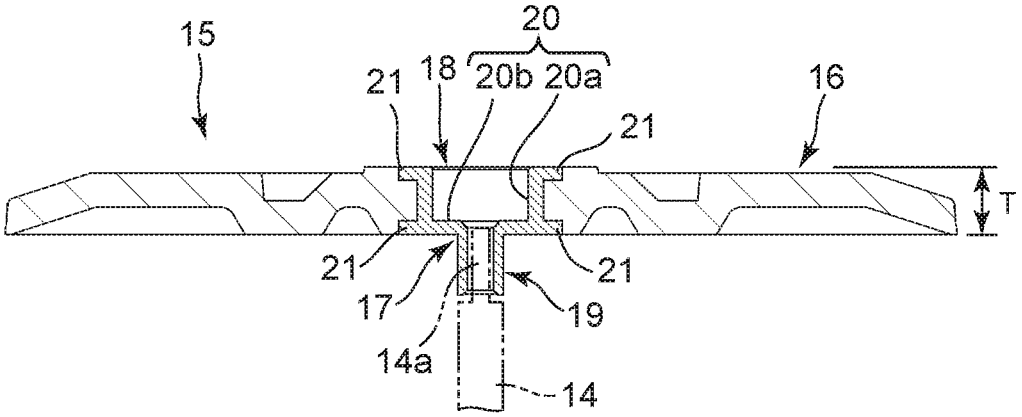
FIG. 3B is an enlarged sectional view showing a cross section of the sub-pointer taken along line B-B in FIG. 2.

The sub-pointer 15 in the sub-display section 9 includes a pointer body 16 made of synthetic resin and a metal pointer attachment section 17 provided in a rotation center portion of this pointer body 16 and referred to as "hakama", and the pointer body 16 and the pointer attachment section 17 are integrally formed by insert molding, as shown in FIG. 2, FIG. 3A and FIG. 3B. In this embodiment, the pointer body 16 is a disk pointer formed to have a substantially disk shape in its entirety by synthetic resin such as Polycarbonate (PC) or Acrylonitrile-Butadiene Styrene (ABS) resin.

This pointer body 16 is provided with an indication section 16*a* that indicates a day of the week in a disk-shaped area, as shown in FIG. 2. This indication section 16*a* is formed such that it has a tapered shape, or in other words, a substantially isosceles triangular shape, and the center of this substantially isosceles triangular shape is positioned at the rotation center of the pointer body 16, that is, the center of the disk-shaped area.

The pointer attachment section 17 is formed of a metal such as phosphor bronze, brass, or aluminum, as shown in FIG. 2 to FIG. 4A and FIG. 4B. Note that, instead of the metal, a material harder than synthetic resin may be used to form the pointer attachment section 17. This pointer attachment section 17 includes a large-diameter section 18 to which the pointer body 16 is fixed and a small-diameter section 19 which is provided coaxially with this large-diameter section 18 and to which the sub-pointer shaft 14 is attached. In this embodiment, the large-diameter section 18 is formed such that its outer diameter is substantially equal to or larger than the thickness T of the pointer body 16.

Figure 4A:
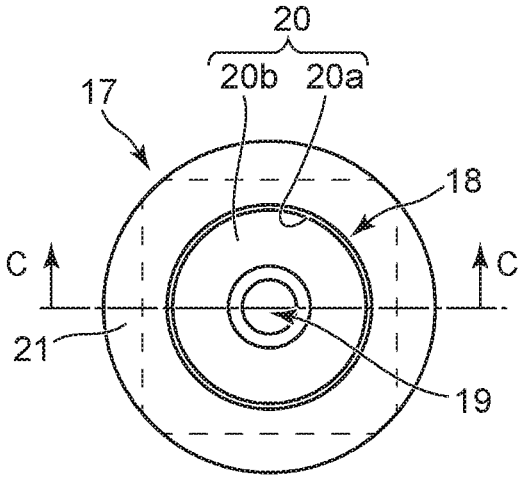
FIG. 4A is an enlarged front view of a pointer attachment section in the sub-pointer shown in FIG. 2.
Figure 4B:
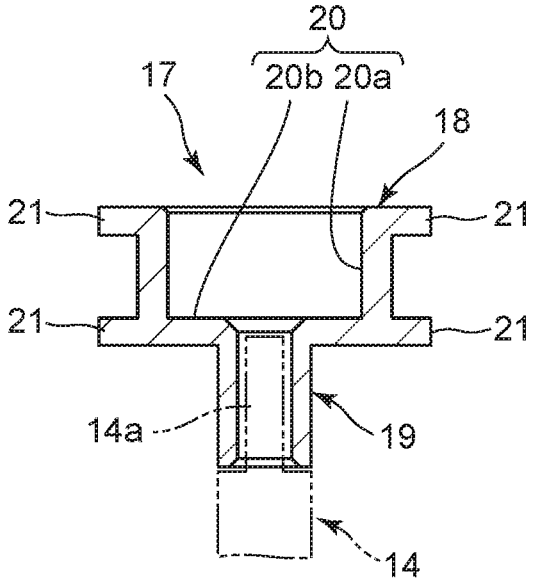
FIG. 4B is an enlarged sectional view taken along line C-C in FIG. 4A.

That is, the large-diameter section 18 is formed to have a substantially cylindrical shape in its entirety, as shown in FIG. 4A and FIG. 4B. This cylindrical large-diameter section 18 is structured such that its outer shape is a square shape, and a mold fixing section 20 which has an outer diameter larger than the outer diameter of the small-diameter section 19 and serves as a positioning section is formed in a center area of the square shape. This mold fixing section 20 is used to fix the pointer attachment section 17 in a later-described mold for molding 23 when the pointer body 16 is molded by the mold 23.

That is, this mold fixing section 20 includes a circular hole 20*a* provided inside the large-diameter section 18 and a bottom section 20*b* provided on the lower surface of this circular hole 20*a*, and is formed to have a concave shape in its entirety, as shown in FIG. 4A and FIG. 4B. In this embodiment, the mold fixing section 20 is formed such that the inner diameter of the circular hole 20*a* is less than the outer diameter of the large-diameter section 18 and is substantially equal to or larger than the thickness T of the pointer body 16. For example, it is formed to be substantially 0.7 mm.

Also, the large-diameter section 18 is formed such that its length in the vertical direction (height) is equal to the thickness T of the pointer body 16, as shown in FIG. 2, FIG. 3A, and FIG. 3B. In this embodiment, pointer fixing sections 21 for fixing the pointer body 16 are provided on the outer periphery of the large-diameter section 18.

These pointer fixing sections 21 are a pair of disk-shaped flange sections provided on an upper end portion and a lower end portion of the outer periphery of the large-diameter section 18 so as to project outwardly, as shown in FIG. 2 to FIG. 4A and FIG. 4B. As a result, the pointer fixing sections 21 are formed such that the pointer body 16 projects into an area between the pair of flanged sections and are fixed on the outer periphery of the large-diameter section 18.

On the other hand, the small-diameter section 19 is formed to have a substantially cylindrical shape in its entirety, and is provided coaxially with the large-diameter section 18, on the undersurface of the bottom section 20*b* of the mold fixing section 20 in the large-diameter section 18, as shown in FIG. 2 to FIG. 4A and FIG. 4B. This small-diameter section 19 is formed such that its length in the vertical direction is substantially equal to the length of the large-diameter section 18 in the vertical direction, that is, the thickness T of the pointer body 16.

Also, this small-diameter section 19 is formed such that its outer diameter is smaller than the thickness T of the pointer body 16 and is smaller than the inner diameter of the circular hole 20*a* of the mold fixing section 20 in the large-diameter section 18. For example, it is formed to be substantially one-third of the inner diameter of the circular hole 20*a*, as shown in FIG. 2 to FIG. 4A and FIG. 4B. That is, this small-diameter section 19, which has the cylindrical shape into which the upper end 14*a* of the sub-pointer shaft 14 is fitted by press fitting, is formed such that its inner diameter is substantially equal to the outer diameter of the upper end 14*a* of the sub-pointer shaft 14. For example, it is formed to be substantially 0.2 mm.

Next, a case where this sub-pointer 15 is molded by insert molding is described.

Figure 5:
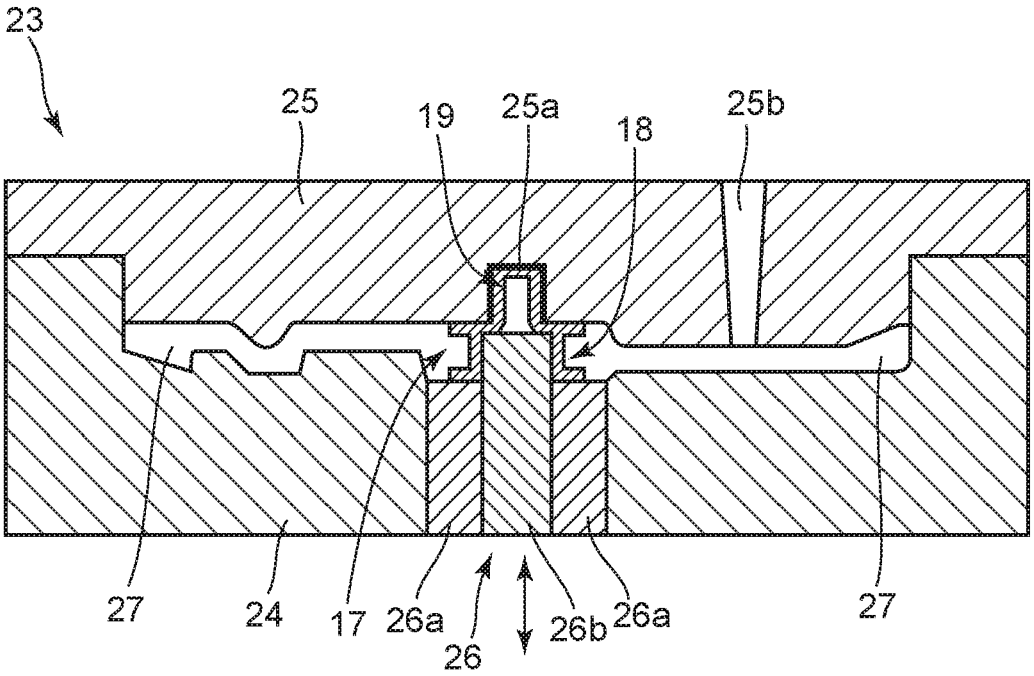
FIG. 5 is an enlarged sectional view showing a state where the sub-pointer shown in FIG. 2 is molded by a mold for molding.

In this embodiment, the mold 23 includes a lower mold 24, an upper mold 25, and a slide core 26, as shown in FIG. 5. The lower mold 24 and the upper mold 25 are structured such that a hollow section 27 which is referred to as a cavity and has the same shape as that of the sub-pointer 15 is formed therebetween when they are overlapped with each other.

That is, the hollow section 27 formed between the lower mold 24 and the upper mold 25 has the same shape as the shape of the sub-pointer 15 when it is vertically reversed, as shown in FIG. 5. In this embodiment, in the lower mold 24, the slide core 26 is provided penetrating therethrough in the vertical direction. This slide core 26 includes a cylindrical guide cylinder 26*a* and a positioning pin 26*b* slidably arranged in this guide cylinder 26*a*, and is provided in the lower mold 24 with it corresponding to a portion of the hollow section 27 where the pointer attachment section 17 in the sub-pointer 15 is positioned.

That is, the guide cylinder section 26*a* is formed such that its outer diameter is slightly larger than the outer diameter of the large-diameter section 18 of the pointer attachment section 17 and its inner diameter is equal to the outer diameter of the positioning pin 26*b*, as shown in FIG. 5. The positioning pin 26*b* is formed such that its outer diameter is larger than the outer diameter of the small-diameter section 19 of the pointer attachment section 17 and is equal to the inner diameter of the circular hole 20*a* of the mold fixing section 20 in the large-diameter section 18 of the pointer attachment section 17. Accordingly, the strength of the positioning pin 26*b* is ensured.

As a result, the positioning pin 26*b* is structured such that it fixes the pointer attachment section 17 in the hollow section 27 in the mold 23 when its leading end is inserted into the circular hole 20*a* of the mold fixing section 20, as shown in FIG. 5. In this embodiment, the positioning pin 26*b* is structured to press the bottom section 20*b* of the mold fixing section 20 against the inner surface of the upper mold 25 and fix the pointer attachment section 17 in the hollow section 27 in the mold 23 when the leading end is inserted into the circular hole 20*a* of the mold fixing section 20 and pressed against the bottom section 20*b* of the mold fixing section 20.

Also, in the upper mold 25, an insertion hole 25*a* into which the small-diameter section 19 of the pointer attachment section 17 is inserted is provided, as shown in FIG. 5. Also, in this upper mold 25, a gate 25*b* for injecting resin into the hollow section 27 in the mold 23 is provided protruding from the upper surface of the upper mold 25 toward the hollow section 27.

When the sub-pointer 15 is to be molded by this mold 23, first, the lower mold 24 and the upper mold 25 are first opened, the small-diameter section 19 of the pointer attachment section 17 is inserted into the insertion hole 25*a* of the upper mold 25, and then the lower mold 24 and the upper mold 25 are overlapped with each other in this state. As a result, the pointer attachment section 17 is arranged in the hollow section 27 in the mold 23. Here, the large-diameter section 18 of the pointer attachment section 17 is arranged between the slide core 26 in the lower mold 24 and the upper mold 25.

In this state, the positioning pin 26*b* of the slide core 26 is inserted into the circular hole 20*a* of the mold fixing section 20 in the large-diameter section 18 of the pointer attachment section 17. Here, the positioning pin 26*b* slides toward the large-diameter section 18 of the pointer attachment section 17 while being guided by the guide cylinder section 26*a* of the slide core 26, and the leading end of this positioning pin 26*b* is inserted into the circular hole 20*a* of the mold fixing section 20 in the large-diameter section 18 of the pointer attachment section 17.

Here, since the outer diameter of the positioning pin 26*b* is equal to the inner diameter of the circular hole 20*a* of the mold fixing section 20 in the large-diameter section 18 of the pointer attachment section 17, or in other words, since it is larger than the outer diameter of the small-diameter section 19 of the pointer attachment section 17, the strength of the positioning pin 26*b* has been ensured. Accordingly, when the leading end of the positioning pin 26*b* is inserted into the circular hole 20*a* of the mold fixing section 20 in the large-diameter section 18 of the pointer attachment section 17, the large-diameter section 18 of the pointer attachment section 17 is pressed against the upper mold 25 by the leading end of the positioning pin 26*b*.

As a result, the bottom section 20*b* of the mold fixing section 20 in the large-diameter section 18 of the pointer attachment section 17 is pressed against the upper mold 25 by the positioning pin 26*b* with the small-diameter section 19 of the pointer attachment section 17 being inserted into the insertion hole 25*a* of the upper mold 25. Accordingly, the pointer attachment section 17 is firmly fixed with its position being accurately regulated inside the hollow section 27 in the mold 23 by the positioning pin 26*b*.

Then, resin is injected from the gate 25*b* of the upper mold 25 and fed into the hollow section 27 in the mold 23. Here, since the pointer attachment section 17 has been fixed in the hollow section 27 in the mold 23 by the positioning pin 26*b*, the pointer attachment section 17 in the hollow section 27 in the mold 23 is not moved or shifted by the injection pressure of the resin fed into the hollow section 27.

As a result, the resin is favorably injected into the hollow section 27, so that the pointer body 16 is molded. Here, the resin projects into an area between the pair of flange sections that are the pointer fixing sections 21 respectively provided on the upper end portion and the lower end portion of the outer periphery of the large-diameter section 18 of the pointer attachment section 17. Therefore, the pointer body 16 is reliably and firmly fixed to the large-diameter section 18 of the pointer attachment section 17. As a result, the sub-pointer 15 where the pointer body 16 and the pointer attachment section 17 have been integrally formed is formed.

Then, the sub-pointer 15 is taken out of the mold 23. Here, the positioning pin 26*b* of the slide core 26 provided in the lower mold 24 is pulled out, and the leading end of the positioning pin 26*b* is extracted from the circular hole 20*a* of the mold fixing section 20 in the large-diameter section 18 in the pointer attachment section 17. In this state, the lower mold 24 and the upper mold 25 are separated from each other so as to extract the small-diameter section 19 in the pointer attachment section 17 inserted into the insertion hole 25*a* of the upper mold 25. As a result, the sub-pointer 15 can be taken out of the mold for molding 23.

Next, a case is described in which the sub-pointer 15 formed as described above is attached to the sub-pointer shaft 14 in the sub-display section 9 so as to be used.

In this case, the small-diameter section 19 of the pointer attachment section 17 of the sub-pointer 15 is mounted on the upper end 14*a* of the sub-pointer shaft 14 incorporated into the timepiece module 5 and positioned at the center of the sub-display area 13 of the sub-display section 9. That is, when the upper end 14*a* of the sub-pointer shaft 14 is inserted by press fitting into the small-diameter section 19 of the pointer attachment section 17, the small-diameter section 19 of the pointer attachment section 17 is attached to the upper end 14*a* of the sub-pointer shaft 14.

Here, the inner diameter of the small-diameter section 19 of the pointer attachment section 17 in the sub-pointer 15 is significantly smaller than the inner diameter of the circular hole 20*a* of the mold fixing section 20 in the large-diameter section 18 of the pointer attachment section 17. For example, the inner diameter of the small-diameter section 19 is as small as substantially 0.2 mm, whereas the inner diameter of the circular hole 20*a* of the mold fixing section 20 is substantially 0.7 mm. As a result, the outer diameter of the upper end 14*a* of the sub-pointer shaft 14 is formed to be small, so that the entire sub-pointer shaft 14 can be formed to be thin.

Accordingly, when the sub-pointer shaft 15 is being moved with it being attached to the sub-pointer shaft 14, the rotational moment of a wheel (not shown) of the sub-pointer shaft 14 rotated by a train wheel mechanism (not shown) is small since the sub-pointer shaft 14 is thin. Therefore, the power consumption of a step motor (not shown) for driving the train wheel mechanism is small, so that power saving can be achieved.

As described above, the sub-pointer 15 in this wristwatch includes the pointer body 16 formed of synthetic resin and the pointer attachment section 17 formed of metal and provided in the rotation center portion of the pointer body 16, and the pointer attachment section 17 includes the large-diameter section 18 to which the pointer body 16 is fixed and the small-diameter section 19 which is provided coaxially with this large-diameter section 18 and to which the sub-pointer 14 is attached. As a result of this structure, the outer diameter of the sub-pointer shaft 14 can be formed small and the pointer body 16 can be favorably molded.

That is, in the sub-pointer 15 in this wristwatch, the outer diameter of the small-diameter section 19 in the pointer attachment section 17 to which the sub-pointer shaft 14 is attached can be formed significantly smaller than the outer diameter of the large-diameter section 18 to which the pointer body 16 is fixed. Therefore, the outer diameter of the sub-pointer shaft 14 which is attached to the small-diameter section 19 of the pointer attachment section 17 can be formed to be minimally small. As a result, the sub-pointer shaft 14 can be formed to be significantly thin.

Also, in the sub-pointer 15 in this wristwatch, the outer diameter of the large-diameter section 18 of the pointer attachment section 17 can be formed significantly larger than the outer diameter of the small-diameter section 19 of the pointer attachment section 17. Therefore, the pointer body 16 can be reliably and favorably fixed to the outer periphery of the large-diameter section 18 and the pointer attachment section 17 can be reliably fixed in the mold 23 by the large-diameter section 18. As a result, the pointer body 16 can be favorably formed on the pointer attachment section 17 by insert molding.

In this embodiment, the large-diameter section 18 of the pointer attachment section 17 is formed such that its outer diameter is substantially equal to or larger than the thickness T of the pointer body 16. Accordingly, by this large-diameter section 18, the pointer attachment section 17 can be reliably fixed in the mold 23. Also, the small-diameter section 19 in the pointer attachment section 17 is formed such that its outer diameter is smaller than the thickness T of the pointer body 16. Therefore, the outer diameter of the small-diameter section 19 can be formed to be minimally smaller than the outer diameter of the outer diameter section 18. As a result, the sub-pointer shaft 14 can be formed to be significantly thin.

Also, in the sub-pointer 15 in this wristwatch, the pointer fixing sections 21 for fixing the pointer body 16 to the outer periphery of the large-diameter section 18 of the pointer attachment section 17 are provided. Accordingly, by these pointer fixing sections 21, the pointer body 16 can be reliably fixed to the pointer attachment section 17. More specifically, these pointer fixing sections 21 are a pair of disk-shaped flange sections provided on the upper end portion and the lower end portion of the outer periphery of the large-diameter section 18 so as to project outwardly. Therefore, the pointer body 16 can be formed to project into the area between the pair of flanged sections. As a result, the pointer body 16 can be reliably and firmly fixed to the outer periphery of the large-diameter section 18.

In this embodiment, the large-diameter section 18 of the pointer attachment section 17 is formed such that its outer periphery has a square shape. Therefore, when the pointer body 16 is fixed to the outer periphery of the large-diameter section 18, the pointer body 16 can be reliably and favorably fixed to the large-diameter section 18 in a manner not to be rotated. By this structure as well, the pointer body 16 can be reliably and firmly fixed to the outer periphery of the large-diameter section 18.

Also, for this sub-pointer 15 in the wristwatch, the pointer body 16 and the pointer attachment section 17 are integrally formed by insert molding. Accordingly, this wristwatch is high in productivity, and can be mass-produced so as to be produced at low cost. That is, when the sub-pointer 5 is to be molded, the pointer attachment section 17 made of metal is arranged inside the hollow section 27 in the mold 23, and resin is injected into the hollow section 27 in the mold 23 in this state, whereby the pointer body 16 and the pointer attachment section 17 are integrally formed.

In this embodiment, in the large-diameter section 18 of the pointer attachment section 17, the mold fixing section 20 for fixing the pointer attachment section 17 to the mold 23 is formed, of which the outer diameter is larger than the outer diameter of the small-diameter section 19. Therefore, when resin is injected into the mold 23, the pointer attachment section 17 can be reliably and favorably fixed in the mold 23 without being moved or shifted within the mold 23 by the injection pressure of the resin.

That is, this mold fixing section 20 is formed to have a concave shape into which the positioning pin 26*b* of the slide core 26 in the mold 23 is inserted, and the inner diameter of this concave shape is larger than the outer diameter of the small-diameter section 19. As a result of this structure, the outer diameter of the positioning pin 26*b* can be formed larger than the outer diameter of the small-diameter section 19, whereby the strength of the positioning pin 26*b* can be ensured.

Accordingly, in the sub-pointer 15, when the pointer attachment section 17 made of metal is to be arranged within the mold 23, the positioning pin 26*b* can be inserted into the concave-shaped mold fixing section 20 in the large-diameter section 18 of the pointer attachment section 17, which can reliably and firmly fix the pointer attachment section 17 in the mold 23.

In this embodiment, the concave-shaped mold fixing section 20 includes the circular hole 20*a* which is larger than the outer diameter of the small-diameter section 19 and formed in the large-diameter section 18, and the bottom section 20*b* provided on the lower surface of this circular hole 20*a*. Therefore, the positioning pin 26*b* can be reliably and favorably inserted into the circular hole 20*a* of the concave-shaped mold fixing section 20 formed in the large-diameter section 18 of the pointer attachment section 17, which can reliably and firmly fix the pointer attachment section 17 in the mold for molding 23.

Also, this concave-shaped mold fixing section 20 can press the leading end of the positioning pin 26*b* against the bottom section 20*b* of the concave-shaped mold fixing section 20 when this leading end of the positioning pin 26*b* is inserted into the circular hole 20*a* of the concave-shaped mold fixing section 20. As a result, the bottom section 20*b* of the mold fixing section 20 can be pressed against the inner surface of the upper mold 25. Therefore, the pointer attachment section 17 can be reliably and firmly fixed in the mold for molding 23.

Note that, although the present embodiment has been described using the case where the mold fixing section 20 in the large-diameter section 18 of the pointer attachment section 17 of the sub-pointer 15 is formed to have a concave shape, the present invention is not limited thereto and the mold fixing section 20 is not necessarily required to be formed in a concave shape. For example, the mold fixing section 20 may be a projection section projecting in the axial direction from the large-diameter section 18.

In this case as well, the mold fixing section 20, which is the projecting section, may be formed such that its outer diameter is equal to or slightly smaller than the outer diameter of the large-diameter section 18 and is sufficiently larger than the outer diameter of the small-diameter section 19 of the pointer attachment section 17. In this structure, the mold 23 is not required to have the slide core 26, and therefore can be simplified.

Also, in the above-described embodiment, the present invention has been applied in the sub-pointer 15 of the sub-display section 9. However, the present invention is not limited thereto. For example, the present invention may be applied in the second hand 12*a* of the main display section 8. That is, the second hand 12*a* may be constituted by a pointer body made of synthetic resin and a pointer attachment section made of metal, and this pointer attachment section may be formed in the same manner as that of the pointer attachment section 17 in the sub-pointer 15.

In this embodiment, the pointer body of the second hand 12*a* is formed to have a long narrow shape. Also, the pointer shaft 11 includes a cylindrical hour hand shaft to which the hour hand 12*c* is attached, a cylindrical minute hand shaft which is rotatably provided within this hour hand shaft and has an upper end to which the minute hand 12*b* is attached, and a second hand shaft which is rotatably provided within this minute hand shaft and has an upper end to which the second hand 12*a* is attached, and these pointer shafts are concentrically located.

In the case of this second hand 12*a* as well, the outer diameter of the second hand shaft in the pointer shaft 11 can be formed small and the pointer body can be favorably molded as with the sub-pointer 15. That is, in the case of this second hand 12*a* as well, the outer diameter of a small-diameter section of the pointer attachment section to which the second hand shaft in the pointer shaft 11 is attached can be made smaller than the outer diameter of a large-diameter section to which the pointer body is attached. Accordingly, the outer diameter of the second hand shaft in the pointer shaft 11 which is attached to the small-diameter section of the pointer attachment section can be made small.

Also, in this second hand 12*a*, the outer diameter of the large-diameter section of the pointer attachment section can be made significantly larger than the outer diameter of the small-diameter section of the pointer attachment section. Accordingly, by this large-diameter section, the pointer attachment section can be reliably fixed in the mold, whereby the pointer body and the pointer attachment section can be favorably formed by insert molding.

In the above-described embodiment and the modification examples, the present invention has been applied in a pointer-type wristwatch. However, the present invention is not necessarily required to be applied in a pointer-type wristwatch. For example, the present invention is widely applicable to various pointer-type timepieces such as a travel watch, an alarm clock, a table clock, and a wall clock.

While the present invention has been described with reference to the preferred embodiments, it is intended that the invention be not limited by any of the details of the description therein but includes all the embodiments which fall within the scope of the appended claims.

What is claimed is:

1. A pointer comprising:
a pointer body formed of synthetic resin; and
a pointer attachment section formed of a material harder than the synthetic resin and provided in a rotation center portion of the pointer body,
wherein the pointer attachment section comprises:
a large-diameter section on to which the pointer body is molded; and
a small-diameter section,
wherein the large-diameter section and the small-diameter section are arranged coaxially along an axis,
wherein the large-diameter section has a first side and a second side,
wherein the first side of the large-diameter section faces a first direction of the axis and the second side of the large-diameter section faces a second direction of the axis opposite to the first direction,
wherein the small-diameter section is provided on the second side of the large-diameter section and attached to a pointer shaft, and
wherein the first side of the large-diameter section comprises:
an axis-facing side wall extending along the axis; and
a bottom section extending towards the axis from the axis-facing side wall, and facing the first direction of the axis,
wherein the axis-facing side wall and the bottom section define a concave shape.

2. The pointer according to claim 1,
wherein the large-diameter section of the pointer attachment section is formed such that an outer diameter of the large-diameter section is substantially equal to or larger than a thickness of the pointer body along the axis, and
wherein the small-diameter section of the pointer attachment section is formed such that an outer diameter of the small-diameter section is smaller than the thickness of the pointer body.

3. The pointer according to claim 1,
wherein the large-diameter section of the pointer attachment section comprises a pair of flanges provided on the first side and the second side of the large-diameter section, respectively, so as to project outwardly from the axis, and
wherein the pointer body is molded on to the large-diameter section to project towards the axis into a space between the pair of flanges.

4. The pointer according to claim 1,
wherein the pointer body and the pointer attachment section are integrally formed by insert molding.

5. The pointer according to claim 1,
wherein an inner diameter of the concave shape as defined by the axis-facing side wall is larger than an outer diameter of the small-diameter section.

6. A timepiece comprising the pointer according to claim 1.

* * * * *